United States Patent [19]

Stenlund

[11] 4,109,868

[45] Aug. 29, 1978

[54] FUEL SUPPLY GOVERNING DEVICE

[75] Inventor: Hans Stenlund, Mölndal, Sweden

[73] Assignee: Gotaverken Angteknik AB, Gothenburg, Sweden

[21] Appl. No.: 757,327

[22] Filed: Jan. 6, 1977

[30] Foreign Application Priority Data

Feb. 3, 1976 [SE] Sweden ..... 7601106

[51] Int. Cl.[2] ..... B05B 7/04

[52] U.S. Cl. ..... 239/413; 239/430

[58] Field of Search ..... 239/413, 430, 431

[56] References Cited

U.S. PATENT DOCUMENTS 3,702,619 11/1972 Son ..... 239/430

3,774,846 11/1973 Shurig et al. ..... 239/430

*Primary Examiner*—James B. Marbert

*Attorney, Agent, or Firm*—Cantor and Singer

[57] ABSTRACT

When burning black liquor obtained during cellulose pulp manufacture it is desirable to maintain a constant atomizing pressure. Mere throttling of the liquor supply in order to adjust the combustion to actual heat demand will alter the spray pattern. A pressurized gaseous fluid is injected into the liquor supply conduit, and the amount of this gaseous fluid is governed in response to the actual heat demand. A monitoring device senses the pressure in the supply conduit downstream of the throttle valve, and adjusts the position of the latter in response to the activity caused by the gaseous fluid, so the resulting pressure is maintained at the desired level.

1 Claim, 2 Drawing Figures

FUEL SUPPLY GOVERNING DEVICE

BACKGROUND OF THE INVENTION

When burning certain kinds of liquid fuels, especially so called black liquor obtained during the manufacture of cellulose pulp, it is desirable to maintain a constant pressure in the fuel supplied to a spray nozzle in a burner, as this will ensure an atomization of the fluid into droplets of uniform size. A reduction of the fuel supply, for instance during an occasional cut-down of the combustion, is brought about in the prior art by a throttling of the supply conduit. That will, however, result in a reduced pressure, which will alter the spray pattern.

SUMMARY OF THE INVENTION

According to the present invention it is possible to govern the supply of liquid fuel to a spray nozzle while maintaining a predetermined atomizing pressure by means of a jet nozzle fitted in a supply conduit to the spray nozzle upstream thereof and adapted to supply a gaseous pressurized fluid, a throttle valve located in said supply conduit upstream of said jet nozzle, means for metering the supply of gaseous fluid, and further means adapted to sense the pressure in the supply conduit downstream of the throttle valve, and by actuation of said throttle valve to maintain the resulting pressure at said predetermined level.

DESCRIPTION OF A PREFERRED EMBODIMENT

Figure 1:
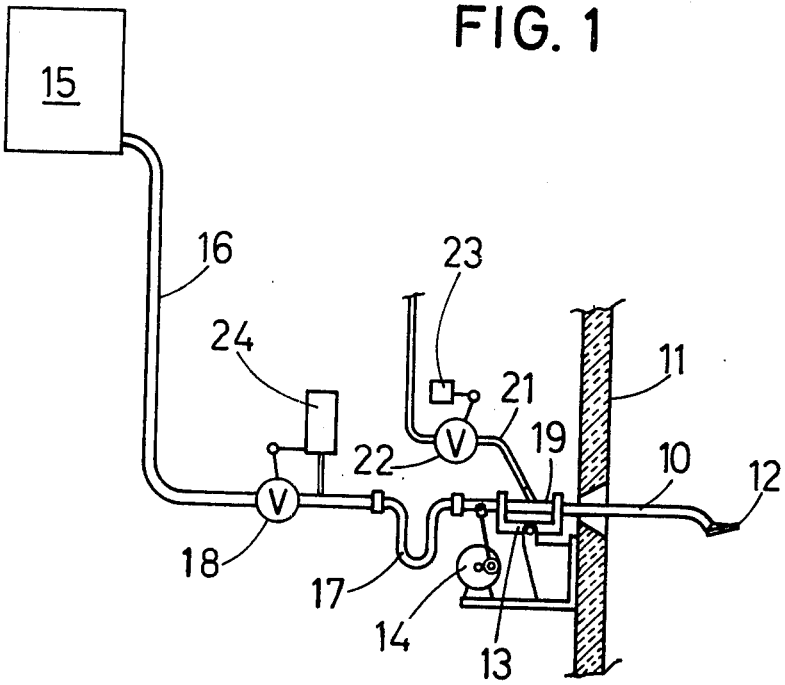
FIG. 1 schematically shows fuel supply systems provided with governing means according to the invention, and FIG. 2, on a larger scale, shows a detail of the supply conduit, with the gaseous fluid supply jet nozzle.

The plant shown in FIG. 1 is adapted for the combustion of black liquor from the cellulose pulp manufacture, and includes a burner 10 of a conventional type for such purpose, fitted in an opening in a wall 11 defining the combustion chamber of a recovery furnace. The burner is provided with a nozzle 12 adapted to spray the liquor in a flat, fanlike patern into the combustion chamber.

The burner 10 is mounted in a cradle 13, and will, in operation, perform an oscillating movement caused by an actuating mechanism 14, as is well known in the art.

The partly dehydrated black liquor is stored in a tank 15 and is conveyed through a conduit 16 to the burner, to which it is connected by means of a connecting member 17 permitting the movements of the burner.

The tank is shown as located at a certain height above the burner in order to illustrate a constant supply pressure, but in practice there is usually a pump (not shown) for maintaining a uniform supply pressure.

A throttle valve 18 is fitted in the supply conduit, and as pointed out above it is not possible to throttle the flow solely with this valve, without reducing the pressure thereof.

Figure 2:
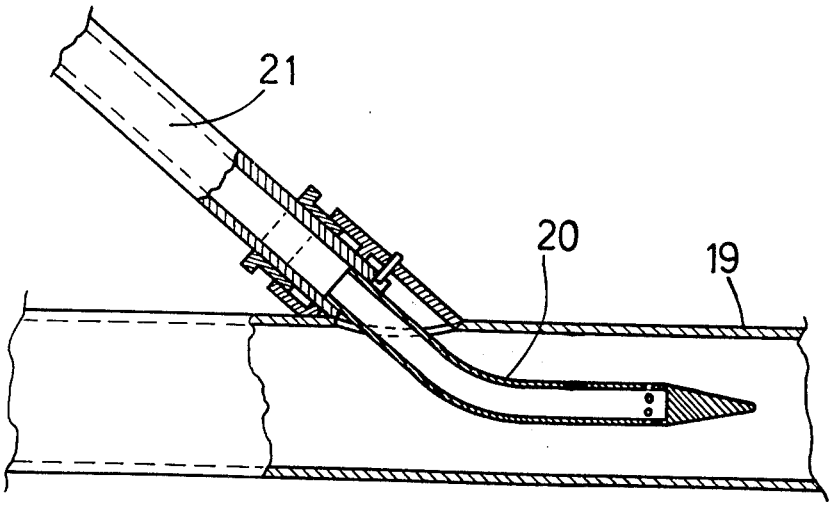

A jet nozzle 20 for a gaseous presurized fluid (FIG. 2), for instance air, is fitted in the supply conduit 19 to the burner. The pressured fluid is supplied by way of a conduit 21, in which a governing valve 22 is fitted. This valve may be adjusted manually or automatically in response to a selected parameter by means of an actuating member 23.

This pressurized fluid will cause a restriction of the flow area within the conduit extending to the spray nozzle, and if a constant volume of liquor is supplied through conduit 16, an increase of the pressure will occur downstream of throttle valve 18. This pressure is continously sensed by a device 24, being connected to conduit 16 downstream of valve 18, and adapted to actuate the latter to decrease the flow of liquor until the pressure has returned to its predetermined level.

The jet nozzle 20 may alternatively be connected to conduit 16, upstream of connecting member 17, and must not be mistaken for such arrangements where a primary atomization of a fuel is brought about for instance by the introduction of steam adjacent to spray nozzle 12.

By using a gaseous pressurized fluid to restrict the area of the conduit, over a distance upstream of the spray nozzle it is possible to avoid throttling means which are subjected to wear and are likely to become clogged. The amount of liquor is easily adjusted in response to fluctuations in the load of the recovery plant, and the atomizing pressure will all the time remain at a constant level.

What I claim is:

1. In a device for governing the supply of liquid fuel to a spray nozzle while maintaining an atomizing pressure at a predetermined level;

(A) means for supplying said liquid fuel at a substantially constant pressure, (B) a first conduit for connecting said supply means with the spray nozzle, (C) a throttle valve in said conduit and first means to operate said throttle valve, (D) a source of pressurized gaseous fluid, (E) a jet nozzle fitted in said first conduit, (F) a second conduit to connect said source of gaseous fluid with said jet nozzle, (G) governing means in said second conduit for metering the supply of said gaseous fluid, and (H) further means for monitoring the pressure in said first conduit, downstream of said throttle valve but upstream of said jet nozzle, and to maintain the combined pressures of said fuel and said gaseous fluid at said predetermined level by actuating the operating means at said throttle valve (I) whereby the pressure of said fuel is affected responsive to the pressure of said gaseous fluid to thereby actuate said monitoring means which consequently causes said throttle valve to adjust the amount of fuel delivered to said nozzle resulting in constant pressure at the same.

* * * * *